US005419084A

United States Patent [19]

Sankey et al.

[11] Patent Number: 5,419,084

[45] Date of Patent: May 30, 1995

[54] DOOR JAMB FINGER GUARD

[75] Inventors: Geoffrey P. Sankey; Christopher W. D. Yeomans, both of Essex, United Kingdom

[73] Assignee: Better Ideas Limited, St. Albans, United Kingdom

[21] Appl. No.: 232,041

[22] PCT Filed: Oct. 29, 1992

[86] PCT No.: PCT/GB92/01978

§ 371 Date: Jun. 15, 1994

§ 102(e) Date: Jun. 15, 1994

[87] PCT Pub. No.: WO93/09325

PCT Pub. Date: May 13, 1993

[30] Foreign Application Priority Data

Oct. 31, 1991 [GB] United Kingdom ..... 9123114

[51] Int. Cl.[6] ..... E05D 11/00

[52] U.S. Cl. ..... 49/383; 16/250; 160/40

[58] Field of Search ..... 49/383; 16/221, 250, 16/223, 251; 160/40

[56] References Cited

U.S. PATENT DOCUMENTS

| | | | |
|---|---|---|---|
| 2,694,234 | 11/1954 | Roby et al. | 49/383 |
| 4,040,142 | 8/1977 | Ippolito | 49/383 X |
| 5,001,862 | 3/1991 | Albenda . | |
| 5,092,077 | 3/1992 | Teinturier-Milgram | 49/383 |
| 5,220,708 | 6/1993 | Lucas et al. | 49/383 X |

FOREIGN PATENT DOCUMENTS

| | | |
|---|---|---|
| 2282032 | 3/1976 | France . |
| 8501481 | 12/1986 | Netherlands . |
| 2218449 | 11/1989 | United Kingdom . |
| 9012945 | 11/1990 | WIPO . |

*Primary Examiner*—Philip C. Kannan
*Attorney, Agent, or Firm*—Smith-Hill and Bedell

[57] ABSTRACT

A door jamb finger guard is described which comprises four elongate strips (10, 12, 14, 16) that are hinged to one another along their edges. The free edges of the first (10) and fourth (16) strips are pivotably connected to two further strips (18, 20) which in use are secured to the door (26) and to the door jamb (24) respectively. The first strip (10) is wider than the fourth strip (16) so as to force the strips (10, 12, 14, 16) to lie against one another when the door (26) is closed.

4 Claims, 2 Drawing Sheets

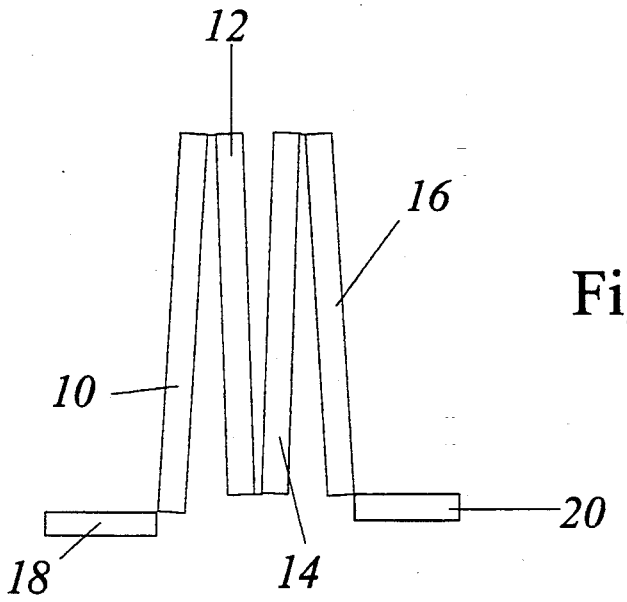
Fig. 1
Fig. 2
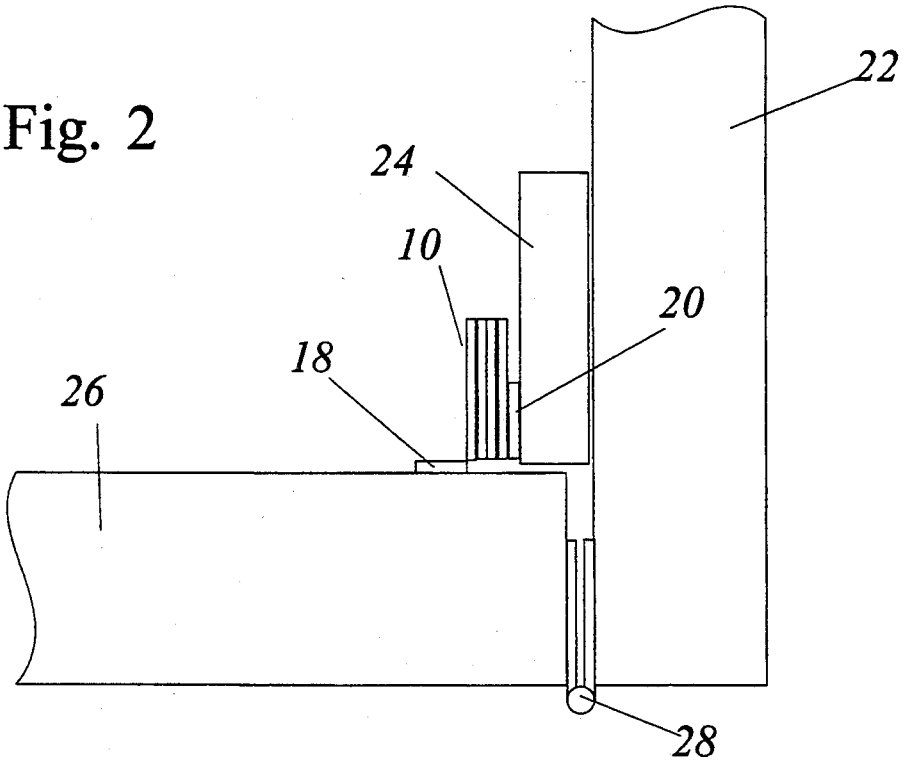

DOOR JAMB FINGER GUARD

FIELD OF THE INVENTION

The present invention relate to a door jamb finger guard.

DESCRIPTION OF THE PRIOR ART

Injuries are often caused, especially to children, by fingers being trapped between a door and a door stop or a door jamb and guards have been proposed in the past which comprise a web of plastics material stretched over the gap between and door and the door jamb when the door is open. It is essential in such guards that they be naturally sprung away from the hinge so as to push away any obstacle as the door closes.

A guard is known from GB-A-2,218,449 which comprises two strips that are hinged to each other and flexibly connected to the door and door jamb long their free edges. The disadvantage of such a guard is that the width of the strips depends on the thickness of the door and on the opening angle (90°–180°). To suit all doors and opening angles a variety of guards must be manufactured and stocked.

OBJECT OF THE INVENTION

The invention seeks to provide a finger guard for a door jamb which can fit a wide range of doors and which has a neat appearance when the door is closed.

SUMMARY OF THE INVENTION

According to the present invention, there is provided a door jamb finger guard comprises four elongate strips which are hinged to one another along their edges, the free edges of the first and fourth strips being pivotably connected to two further strips which in use are secured to the door and to the door jamb respectively, the first strip being wider than the fourth strip so as to force the strips to lie against one another when the door is closed.

The four strips can be folded in the manner of a ladies' fan to lie against one another when the door is closed and form a web extending across the gap between the door and the door jamb when the door is open to act as a finger guard. Because four strips are used to bridge the gap, the total width of the finger guard when the door is closed is smaller than that required in a guard with only two strips and a neater appearance is thereby achieved.

Though the prior art does not explicitly show any finger guards having more than two strips reference, GB-A-2,119,938 refers implies without any elaboration that more that two strips can be used. For example, claim 5 of the publication refers to "at least two strips intermediate the end strips". There is however no teaching to use four and only four strips, as proposed in the present invention. In practice, using more than four strips is not satisfactory because the web becomes too flexible and does not positively prevent fingers from being trapped. Furthermore the web does not store away neatly.

The present invention is based on the discovery that if four and only four strips are used, the web retains sufficient resilience to prevent fingers from being trapped and by making the first strip longer (or the last strip shorter) than the rest of the strips the guard can still be made to fold neatly and lie against the door or the door jamb.

The further strips connected to the free ends of the four sections constituting the web may be secured to the door and door jamb or door stop by an adhesive or other fixing means such as screws or nails.

Conveniently, the guard may be formed in one piece by extruding a plastics material which is suitable for forming film hinges.

The guard should be formed of a length covering all the parts of the door gap which present a hazard but it is not essential for the strips to be the height of the entire door. In schools, for example, the guard need only cover the lower part of a door and in a building used by adults only the central section of the door need be guarded.

BRIEF DESCRIPTION OF THE DRAWINGS

The invention will now be described further, by way of example, with reference to the accompanying drawings, in which:

FIG. 1 is a section through a finger guard of the invention,

FIG. 2 shows the finger guard of FIG. 1 when fitted to a door,

DETAILED DESCRIPTION OF THE PREFERRED EMBODIMENTS

Figure 3:
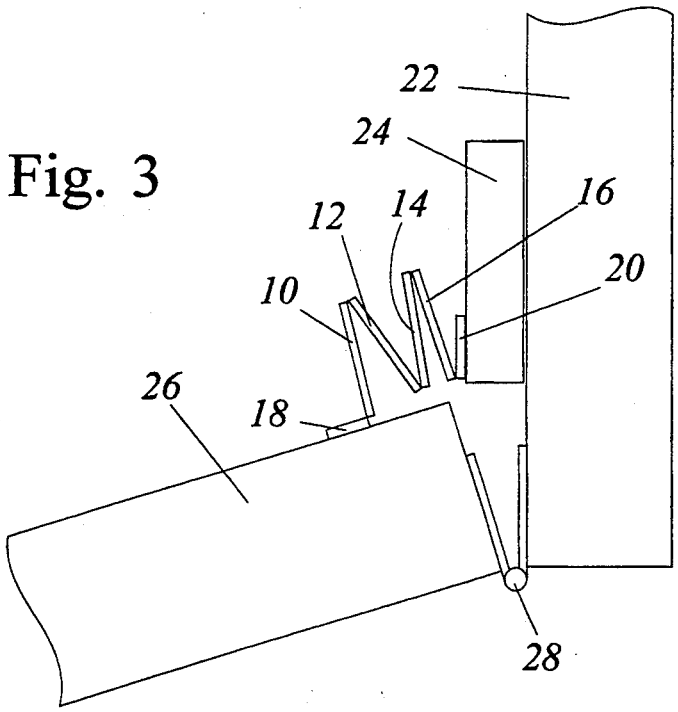
FIG. 3 shows the door of FIG. 2 when partly opened.

The finger guard of FIG. 1 is formed as a single plastics extrusion and comprises four strips 10, 12, 14 and 16 which are hinged to one another in the manner of a ladies' fan or a concertina to stretch across the gap between a door and a door stop. The width of the strips 10, 12, 14 and 16 is typically of the order 34 mm. The strip 10 is intentionally made slightly, for example 1 mm, wider than the other three strips 12, 14 and 16. Two further strips 18 and 20 are hinged to the first strip 10 and the last strip 16 and these act as a means of attachment to the door and door jamb, respectively.

FIGS. 2 and 3 show the finger guard of FIG. 1 when fitted to a door. In FIG. 2 the door is closed whereas is FIG. 3 it is slightly ajar. In both Figures, the door is designated 26, the door jamb 22, the door stop 24 and the hinge 28.

The fixing strips 18 and 20 are attached securely to the door 26 and the door stop 24, respectively, by means of an adhesive. A double sided adhesive strip may be used for this purpose but alternatively an adhesive may be applied directly to the strips 18 and 20 and protected by a peel-off backing. In this case, the backing may simply be peeled off and the guard pressed into position.

When the door is closed, all the strips 10, 12, 14 and 16 lie flat against one another as shown in FIG. 2 and also flat against the door stop 24, making for an unobtrusive appearance. Because the first strip 10 is longer than the others, it urges the other strips 12, 14 and 16 against the door stop 24 when the door is closed. As the door is opened, the guard stretches across the gap the between the door and the door jamb to prevent fingers being trapped. Even if an attempt is intentionally made to push the finger guard into the gap the geometry of the guard forces the guard strips away from the gap as the door closes.

Figure 4:
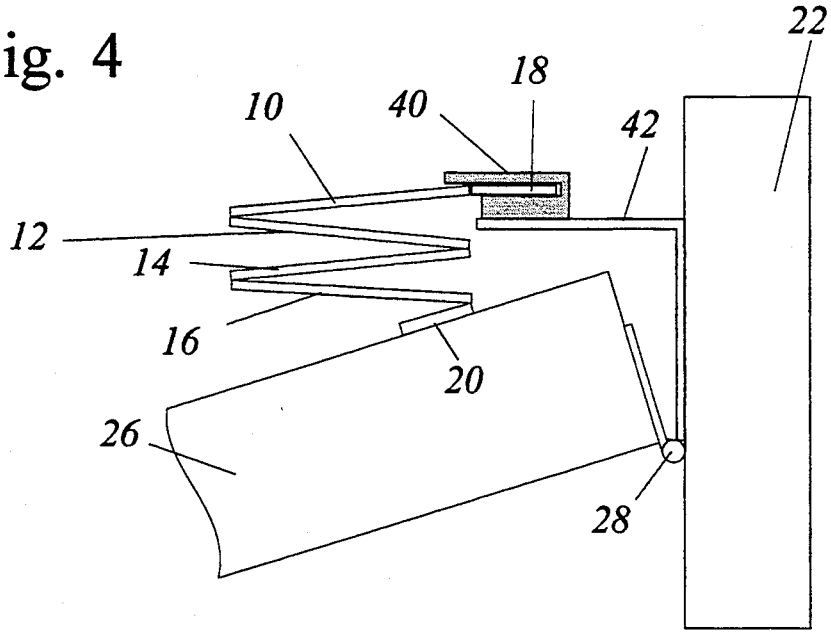
FIG. 4 is a view similar to that of FIG. 3 showing an alternative door construction in which the finger guard lies against the door rather than the door jamb when the door is closed.

FIG. 4 shows a finger guard fitted to an alternative type of door. With aluminium doors and PVC doors, a frame 42 is mounted on the wooden door surround 22 and this prevents the finger guard from being attached in the manner illustrated in FIG. 3.

To avoid the guard protruding in an unsightly manner from the door, the guard is arranged to lie against the door rather than the door jamb when the door is closed. To this end, a separate mount 40 of U-shaped cross section is first secured to the door frame 42. The strip 18 of the finger guard is now inserted into the mount 40 as illustrated in FIG. 4. The mount 40 may be of plastics material or aluminium and indeed it may be formed integrally with the frame 42 from a single extrusion. The strip 18 may be retained by adhesive within the channel of the mount 40 but in this case a mechanical interlocking fixing would suffice. If the door 26 is made with a suitable recess, the strip 20 may also be retained by a mechanical fixing thereby allowing a simple installation of the finger guard.

The upper limb of the mount 40 projects beyond the hinge line between the strips 18 and 10. This elongation of the upper limb assists in providing a neat appearance when the door is closed. The strip 10 can bend down as viewed in FIG. 4 to follow movements of the door 26, but when the door closes, the strip 10 is pushed up against the stop formed by the upper limb of the mount 40. In this embodiment, by making the strip 10 wider than the other strips, a clearance is also ensured between the ends of the other strips and the door frame 42.

We claim:

1. A door jamb finger guard comprises four elongate strips (10,12,14,16) which are hinged to one another along their edges, the free edges of the first (10) and fourth (16) strips being pivotably connected to two further strips (18, 20) which in use are secured to the door (26) and to the door jamb (24) respectively, the first strip (10) being wider than the fourth strip (16) so as to force the strips (10,12,14,16) to lie against one another when the door (26) is closed.

2. A finger guard as claimed in claim 1, wherein the four strips (10,12,14,16) and the two further strips (18,20) are formed integrally of plastics material with film hinges between the individual strips.

3. A finger guard as claimed in claim 1, further comprising a separately formed mount (40) which in use is secured to a frame (42) surrounding the door (26), the mount (40) having a channel for receiving one of the two further strips (20) of the finger guard and serving to hold the strips parallel to the surface of the door when the door is closed.

4. A finger guard as claimed in claim 3, wherein the four strips (10,12,14,16) and the two further strips (18,20) are formed integrally of plastics material with film hinges between the individual strips.

* * * * *